US005860193A

United States Patent [19]

Wang

[11] Patent Number: 5,860,193

[45] Date of Patent: Jan. 19, 1999

[54] TOP STOP FOR A ZIPPER

[76] Inventor: Wallace Wang, 1F., No. 30, Lane 252, San Jiunn Street, Shu Lin Chen, Taipei County, Taiwan

[21] Appl. No.: 78,561

[22] Filed: May 14, 1998

[51] Int. Cl.[6] ..... A44B 19/00

[52] U.S. Cl. ..... 24/436; 24/429; 24/433

[58] Field of Search ..... 24/436, 419, 429, 24/430, 433, 437

[56] References Cited

U.S. PATENT DOCUMENTS

| | | | |
|---|---|---|---|
| Re. 18,571 | 8/1932 | Avedon | 24/433 |
| 2,573,059 | 10/1951 | Rabinow et al. | 24/436 |
| 3,077,651 | 2/1963 | Morin | 24/436 |
| 3,805,339 | 4/1974 | Howell | 24/436 |
| 4,023,241 | 5/1977 | Kanzaka | 24/436 |

*Primary Examiner*—Victor N. Sakran
*Attorney, Agent, or Firm*—Varndell Legal Group

[57] ABSTRACT

A top stop integral with a zipper tape for a zipper, the top stop including an upper stop block having a front stop face and a rear stop projection, the rear stop projection and the front stop face being respectively stopped at a top edge of the slide of the zipper and one side of a partition wall inside the slide to prohibit the slide from escaping out of engagement with the row of teeth on the zipper tape, and a lower stop block having a connecting portion downwardly extended from the bottom edge thereof and connected to a top edge of a first tooth of the row of teeth on the zipper tape.

2 Claims, 7 Drawing Sheets

TOP STOP FOR A ZIPPER

BACKGROUND AND SUMMARY OF THE INVENTION

The present invention relates to zippers, and more specifically to an improved structure of top stop for a zipper.

A regular zipper, as shown in FIGS. 1 and 2, comprises a top stop at one zipper tape for stoping the slide (not shown) in place. The top stop is comprised of an upper stop block and a lower stop block. A gap is defined between the upper stop block and the lower stop block. Through the gap between the upper stop block and the lower stop block, the slide is inserted into engagement with the row of teeth on the zipper tape or pulled outwards and disengaged from the row of teeth. This structure of top stop can not effectively stop the slide from escaping out of engagement with the row of teeth when the slide is pulled to the upper limit position with a high pulling force. Furthermore, when the slide is pulled with a high pulling force, the lower stop block may be driven out of the zipper tape.

The present invention has been accomplished to provide a top stop for a zipper which eliminates the aforesaid drawbacks. According to one aspect of the present invention, the upper stop block of the top stop has a front stop face and a rear stop projection. When the slide is pulled upwards to the upper limit position, the rear stop projection and the front stop face are respectively stopped at a top edge of the slide of the zipper and one side of a partition wall inside the slide to prohibit the slide from escaping out of engagement with the row of teeth on the zipper tape. According to another aspect of the present invention, the lower stop block has a bottom edge spaced from the row of teeth on the zipper tape at a distance, and a connecting portion downwardly extended from the bottom edge and connected to a top edge of a first tooth of the row of teeth on the zipper tape. According to still another aspect of the present invention, the lower stop block has a transverse length shorter than the length of the teeth on the zipper tape, and a sloping top edge spaced from a sloping bottom edge of the upper stop block by a gap. Therefore, the lower stop block enables the slide to be conveniently inserted through the gap between the upper stop block and the lower stop block into engagement with the teeth on the zipper tape.

DETAILED DESCRIPTION OF THE PREFERRED EMBODIMENT

Figure 5:
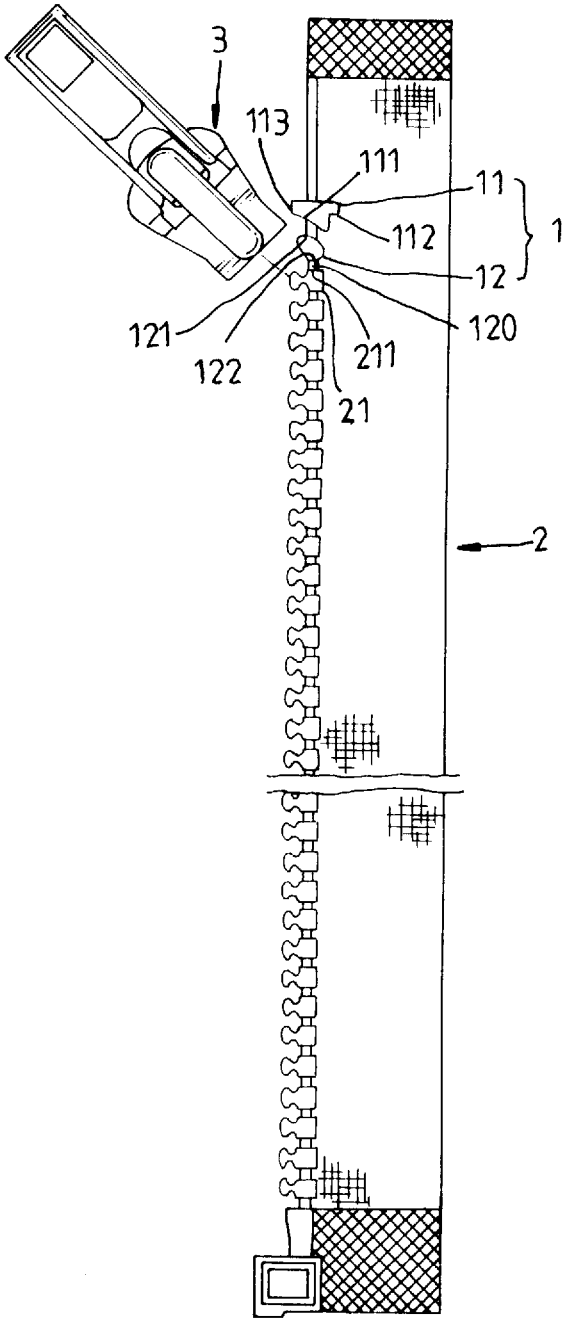
FIG. 5 is a top view of the preferred embodiment of the present invention before the installation of the slide.
Figure 6:
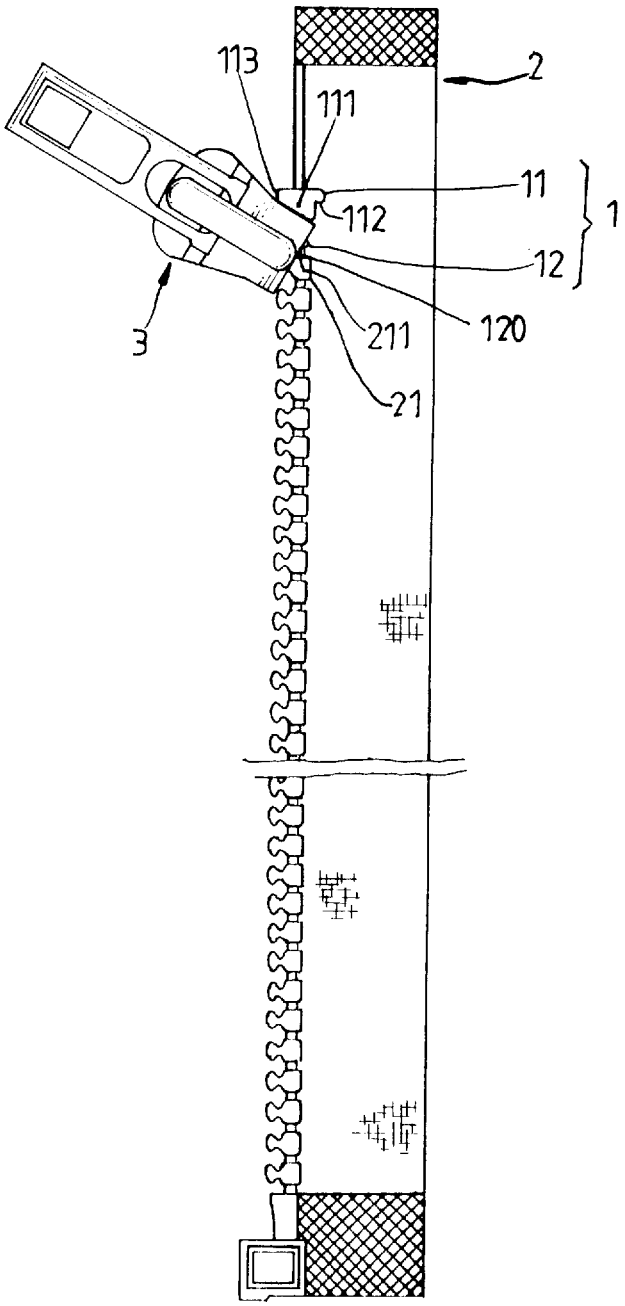
FIG. 6 is similar to FIG. 5, but showing the slide inserted into the gap between the upper stop block and the lower stop block.

Referring to FIGS. from 3 to 8, a top stop 1 is injection-molded on a zipper tape 2 at one end of the row of teeth 21 on the zipper tape 2. The top stop 1 is comprised of an upper stop block 11, and a lower stop block 12. The upper stop block 11 has a sloping bottom edge 111. The transverse length of the upper stop block 11 is greater than the length of the teeth 21. The lower stop block 12 is spaced between the upper stop block 11 and the row of teeth 21. The lower stop block 12 has a bottom edge 122 spaced from the row of teeth 21 at a distance, and a sloping top edge 121 spaced from the sloping bottom edge 111 of the upper stop block 11 by a gap 4. Through the gap 4 between the sloping bottom edge 111 of the upper stop block 11 and the sloping top edge 121 of the lower stop block 12, a slide 3 is forced into connection with the zipper tape 2 (see FIGS. 5 and 6).

Figure 7:
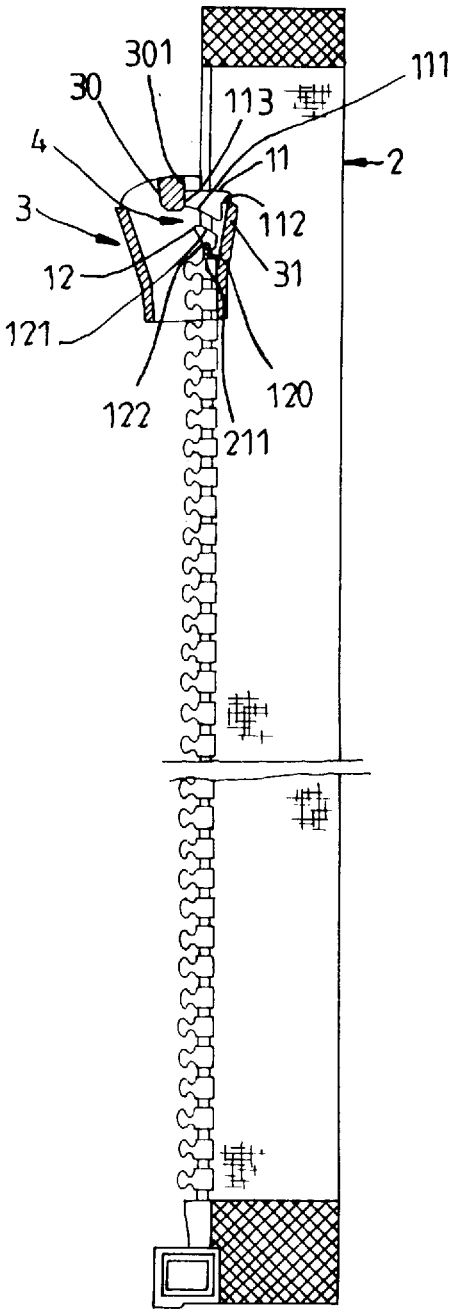
FIG. 7 is sectional view showing the slide coupled to the teeth on the zipper tape and stopped below the uppper stop block according to the present invention.
Figure 8:
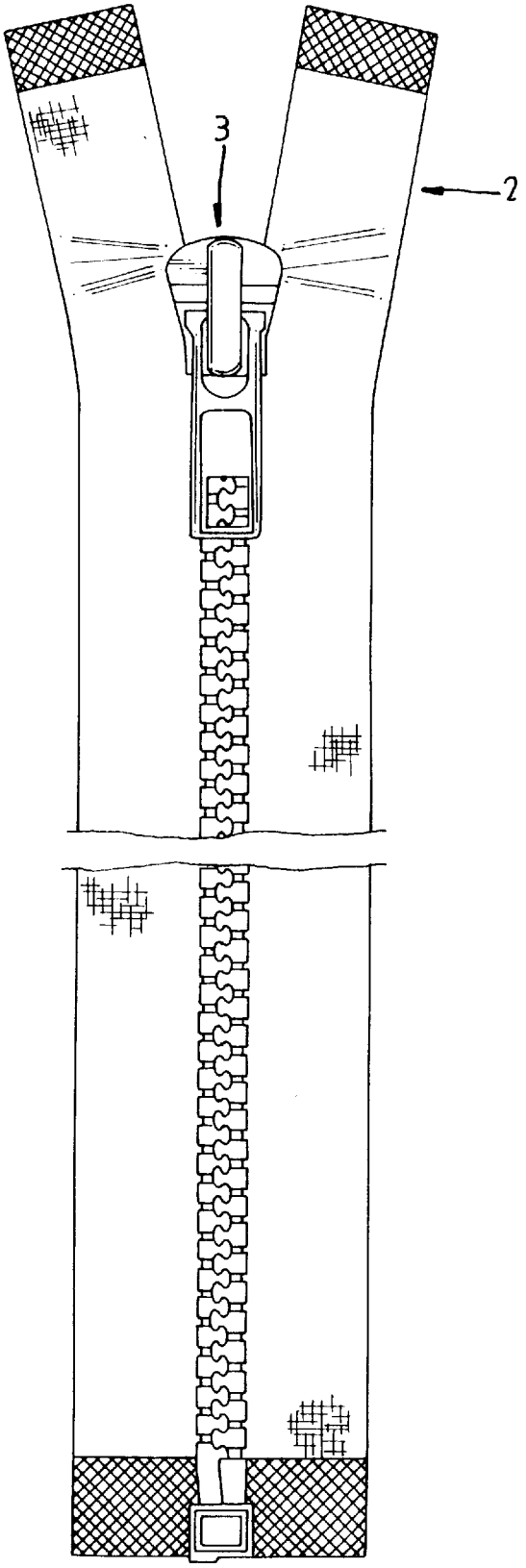
FIG. 8 is a plain view of the present invention, showing the top stop integral with the zipper tape.

The upper stop block 11 has a front stop face 113 at the front side remote from the zipper tape 2, and a rear stop projection 112 at the rear side on the zipper tape 2. When the slide 3 is pulled to the upper limit position after installation, the rear stop projection 112 of the upper stop block 11 is stopped at a top edge 31 of the slide 3, and the front stop face 113 of the upper stop block 11 is stopped at one side 301 of an inside partition wall 30 of the slide 3, and therefore the slide 3 is stopped from escaping out of the constraint of the top stop 1 (see FIG. 7).

Figure 1:
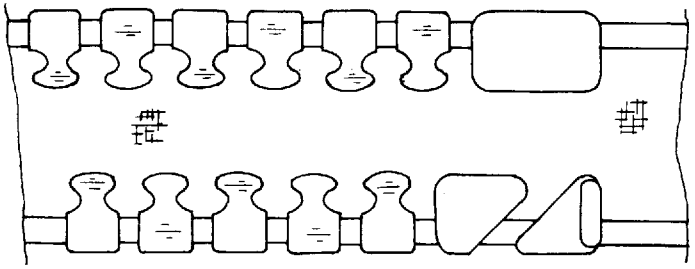
Fig. 1 PRIOR ART
FIG. 1 is a plain view of a zipper according to the prior art.
Figure 2:
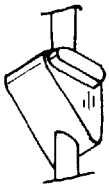
Fig. 2 PRIOR ART
FIG. 2 is a perspective view of the upper stop block of the top stop of the zipper shown in FIG. 1.
Figure 3:
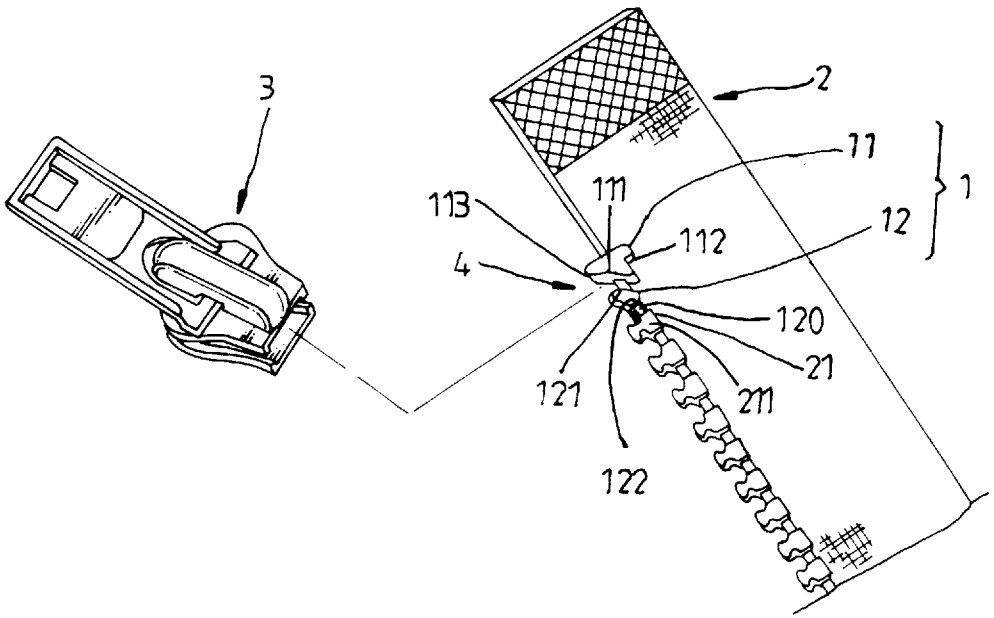
FIG. 3 is a perspective view of the preferred embodiment of the present invention before the installation of the slide.
Figure 4:
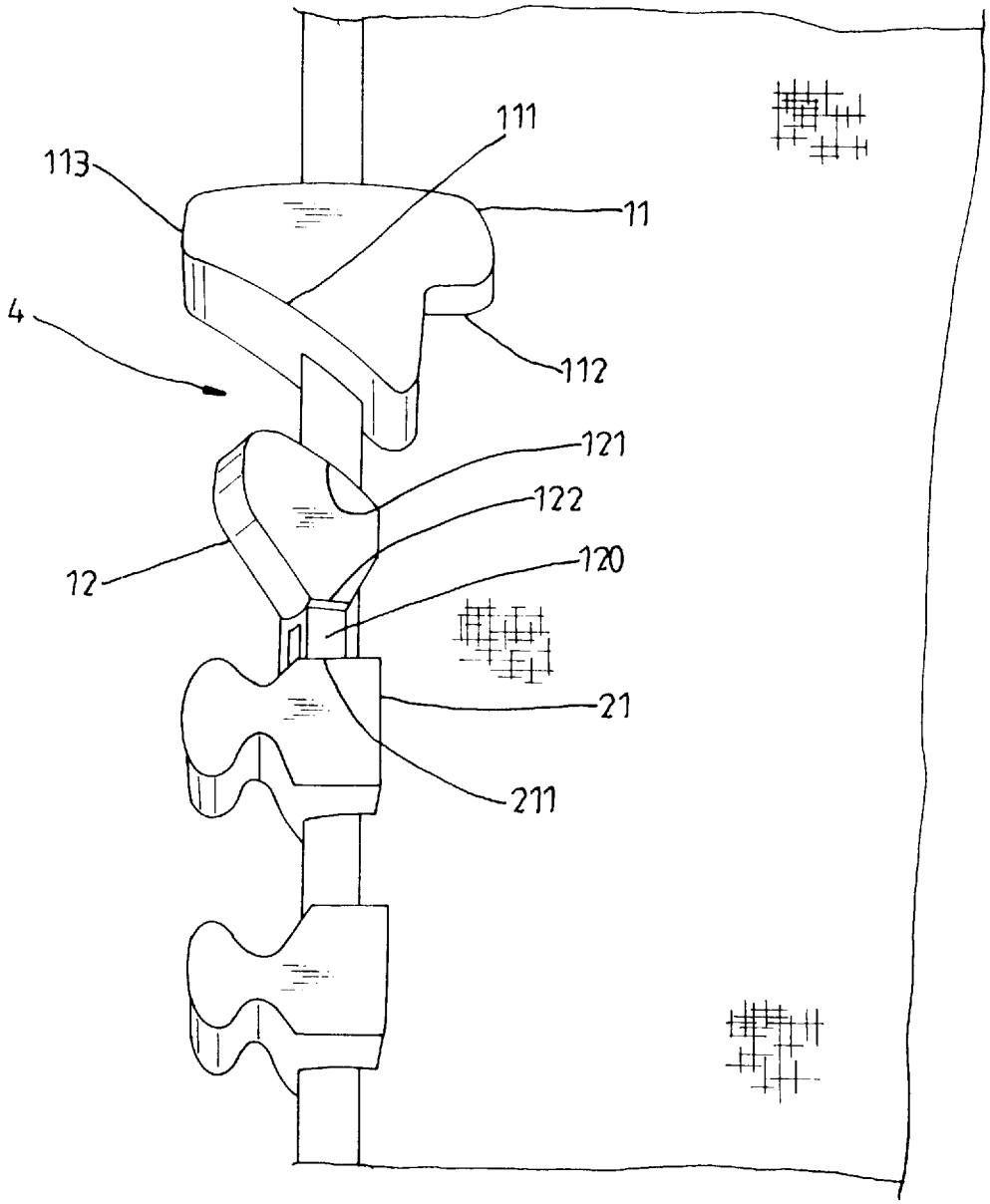
FIG. 4 is an anlarged view of a part of FIG. 3, showing the top stop integral with the zipper tape.

The lower stop block 12 comprises a connecting portion 120 downwardly extended from the bottom edge 122 and connected to the top edge 211 of the first tooth of the row of teeth 21. The lower stop block 12, the connecting portion 120 and the first tooth of the row of teeth 21 are injection-molded on the zipper tape 2 in integrity (see FIG. 4). Because the lower stop block 12, the connecting portion 120 and the first tooth of the row of teeth 21 are integral with the zipper tape 2, fastening the slide 3 to the zipper tape 2 or disconnecting the slide 3 from the zipper tape 2 does not force the lower stop block 12 out of place.

Furthermore, the transverse length of the lower stop block 12 is shorter than the length of the teeth 21, and the sloping top edge 121 of the lower stop block 12 has both ends smoothly chamfered. Therefore, when the slide 3 is inserted into the gap 4, the partition wall 30 is not hindered in its movement with the slide 3, allowing the slide 3 to be smoothly coupled to the zipper tape 2.

I claim:

1. A top stop integral with a zipper tape having a row of teeth and slide sliding on said row of teeth, to stop said slide from escaping out of said row of teeth, said top stop comprising an upper stop block having a sloping bottom edge and a transverse length greater than the length of said teeth, and a lower stop block having a bottom edge spaced from said row of teeth at a distance and a sloping top edge spaced from the sloping bottom edge of said upper stop block by a gap, wherein said upper stop block comprises a front stop face at a front side thereof remote from said zipper tape, and a rear stop projection at a rear side thereof integral with said zipper tape, said rear stop projection and said front stop face being respectively stopped at a top edge of said slide and one side of a partition wall inside said slide to prohibit said slide from escaping out of engagement with said row of teeth when said slide is pulled to an upper limit position; said lower stop block comprises a connecting portion downwardly extended from the bottom edge thereof and connected to a top edge of a first tooth of said row of teeth.

2. The top stop of claim 1 wherein said lower stop block has a transverse length shorter than the length of said teeth, and the sloping top edge of said lower stop block has both ends smoothly chamfered.

* * * * *